US005327830A

United States Patent [19]

Gelinas et al.

[11] Patent Number: 5,327,830

[45] Date of Patent: Jul. 12, 1994

[54] PORTABLE, REMOVABLE AND INSERTABLE INK FOUNTAIN BOX FOR A PRINTING MACHINE

[75] Inventors: W. Robert Gelinas, Jewitt City; Craig L. Whipple, Ledyard, both of Conn.

[73] Assignee: MAN Roland Druckmaschinen AG, Offenbach am Main, Fed. Rep. of Germany

[21] Appl. No.: 30,646.

[22] Filed: Mar. 12, 1993

Related U.S. Application Data

[63] Continuation-in-part of Ser. No. 897,802, Jun. 12, 1992, abandoned.

[51] Int. Cl.[5] ..... B41F 31/06; B41F 31/20; B41D 27/08

[52] U.S. Cl. ..... 101/363

[58] Field of Search ..... 101/350, 363, 364, 207, 101/208-210, 148, 355, 356, 360, 365, 366, 351, 352; 118/259, 261

[56] References Cited

FOREIGN PATENT DOCUMENTS 9113480.3 2/1992 Fed. Rep. of Germany .

*Primary Examiner*—J. Reed Fisher

*Attorney, Agent, or Firm*—Frishauf Holtz Goodman & Woodward

[57] ABSTRACT

To permit easy removal of a printing machine inker fountain box, without leakage of ink from the box, the box is formed with a box body (1) and side walls (3) which have curved front faces (12) fitting against an inker roller (9). To remove the box, for example by lifting off with handles (2) from a printing machine, a curved cover (4) is inserted into guide slots (5) formed in the side walls, which are located just inside of the end surfaces (12) of the end walls. The cover, preferably, has a stripper element (6) at the end, so that, as it is inserted into the curved slots (5), ink on the inker roller (9) is stripped downwardly leaving, at the end, only a small accumulation of ink (19) which can easily be wiped off. The bottom of the inker cover (4) fits against the inker body (1) to prevent leakage of ink from the now removable inker box (1). To permit return of ink stripped off the inker roller (9) in operation of the machine by a doctor blade (22) mounted on the inker body (20), the bottom wall (1') of the inker body is formed with a recessed edge (127) or a group of apertures (27) therein, which can be closed off by a flap (28) of a flap valve, or by a sealing strip or flap (28, 928) secured to the cover (4) and overlapping the opening (127) or openings (28) when the cover is inserted in the guide slots.

21 Claims, 5 Drawing Sheets

PORTABLE, REMOVABLE AND INSERTABLE INK FOUNTAIN BOX FOR A PRINTING MACHINE

This application is a continuation-in-part of application Ser. No. 07/897,802, filed Jun. 12, 1992, now abandoned.

FIELD OF THE INVENTION

The present invention relates to printing machinery, and more particularly to a removable ink fountain box, which can, selectively, be inserted in the printing machine while retaining ink, exposing a side of the box to an ink application roller, and then removed from the printing machine without, essentially, unintended leakage of ink from the box upon insertion and removal, and which is easy to clean and easily handled.

BACKGROUND

It is frequently necessary to exchange ink fountain boxes in printing machines, for example to exchange ink of a specific color with differently colored ink. In rotary printing machines, particularly offset printing machines, it is customary to form the ink fountain boxes in such a manner that they are removable. Removal and interchange of ink fountain boxes causes problems if the ink fountain box is directly engaged against an inker roller of the printing machine inker. In such arrangements, the forward region of the inker box is open, that is, exposed to a roller so that the roller can have ink directly applied from the box, or pick up ink which flows downwardly from the box.

It is, of course, possible to install the inker box in the printing machine, when empty, and then fill ink thereinto. If the inker box is to be exchanged, however, and removed, ink may still be within the inker box and, upon removal from the printing machine, may leak off. The ink is quite viscous. In the past, this required removal of the ink from the inker box or inker fountain box before the fountain box itself could be removed from the printing machine. This is time-consuming, and frequently difficult to carry out because of the nature of the ink. Contamination, soiling and loss of ink is practically unavoidable.

It has previously been proposed to provide inker boxes with a forward cover, which is formed with an opening that can be closed by a valve closing element. This arrangement permits exchanging of inker fountain boxes with ink still therein; due the nature of the ink, however, such closure elements are difficult to handle and, if the inker box is to be used with ink of a different color, the closure valve element additionally requires cleaning.

THE INVENTION

It is an object to provide an ink fountain box which is simple, permits easy placement of the fountain box in a printing machine, whether full or empty of ink, and removal of the ink fountain box, even though it still retains ink, without the danger of leakage of ink or run-out of ink upon removal.

Briefly, the ink fountain box has a body structure which forms a back wall and, preferably, a bottom wall or a curved or angled back-bottom wall combination. The ink box further has two side walls which have forward edges curved to match the curvature of an inker roller, and bearing against the inker roller to form lateral seals. The side walls, additionally, are formed with a guide arrangement, for example guide slots, defining a guide path, located closely adjacent the forward edges, for selective insertion and removal of a cover element which, preferably, likewise is curved to easily slide into the guide arrangement. The forward cover element extends down to the body, to form a closure with respect thereto.

The ink fountain box, with the cover installed, can thus be filled at a point remote from the printing machine with ink of a selected color. Due to the viscous nature of the ink, hardly any ink will leak out between the joint of the cover and the body, and will all be retained within the ink reservoir defined by the body, the side walls and the forward cover. After installation of the ink box in the printing machine, the cover is removed and the ink roller is exposed to ink within the ink reservoir. For removal of the fountain box, the cover is again inserted in the guide arrangement, to close off the ink reservoir from the roller.

In accordance with a feature of the invention, the cover has a small ink stripper element, engageable with the ink roller, and projecting therefrom, which strips a film of ink off the ink roller upon insertion of the cover element. Preferably, this ink stripper element is made of a plastic material, for example nylon. The ink fountain box has handles for easy transportiong, placing in position and removal, and the cover element, likewise, is formed with handles for ease of insertion and removal.

The ink box fits within an inker body structure of the printing machine. In operation, the printing roller transports ink on its surface, which is metered or stripped off by a doctor blade. Ink will accumulate in the space between the inker body and the bottom wall of the fountain box. In accordance with a feature of the invention, a valve is provided which permits escape of ink from this space between the inker box and the inker body back into the inker box. Since, in operation, the inker roller rotates, ink is forcibly fed by pressure due to continuous feed of ink from the inker roller back into the inker box through the valve. The valve is so constructed that, upon cessation of this back-pressure, the flap valve will close. Thus, the inker box can be removed with all the ink therein which is left, and only the very small amount of remanent ink within the inker body will have to be cleaned.

A flap valve can be formed in various ways; for example, the bottom wall of the inker box can be formed with openings therein, covered by a resilient, for example a rubber sheet or strip which will automatically seal against the holes when pressure of ink through the holes is removed. The flap valve can be attached also to the cover, to be placed in position only when the cover is closed, and prevent escape of ink through back-flow openings, or a foreshortened end edge of the ink box. Alternatively, a scaling element can be attached to the removable cover, to close over an opening or openings in the bottom wall of the insert ink box when the cover is placed in the ink box prior to removal from the printing machine.

DRAWINGS

DETAILED DESCRIPTION

Figure 1:
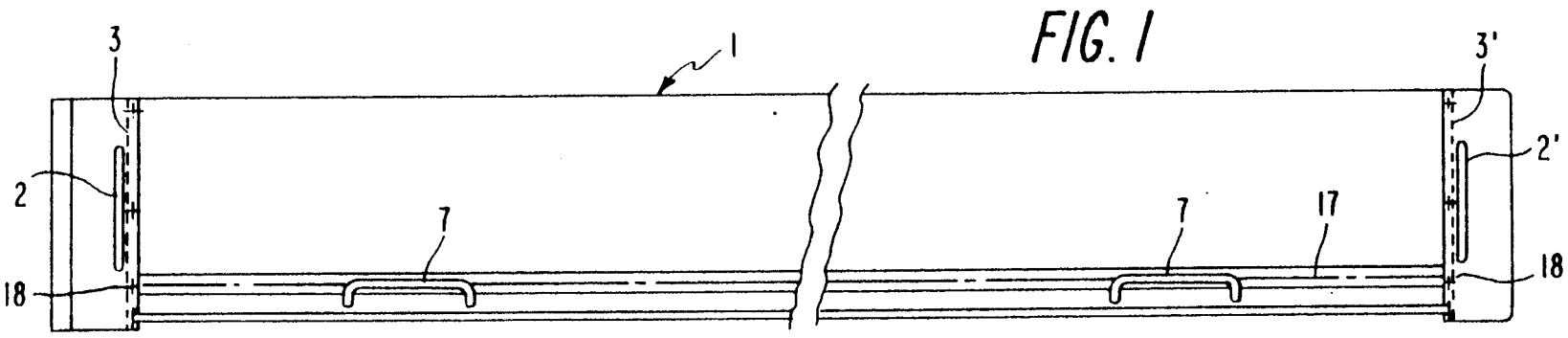
FIG. 1 is a highly schematic top view of the ink fountain box in accordance with the present invention.
Figure 2:
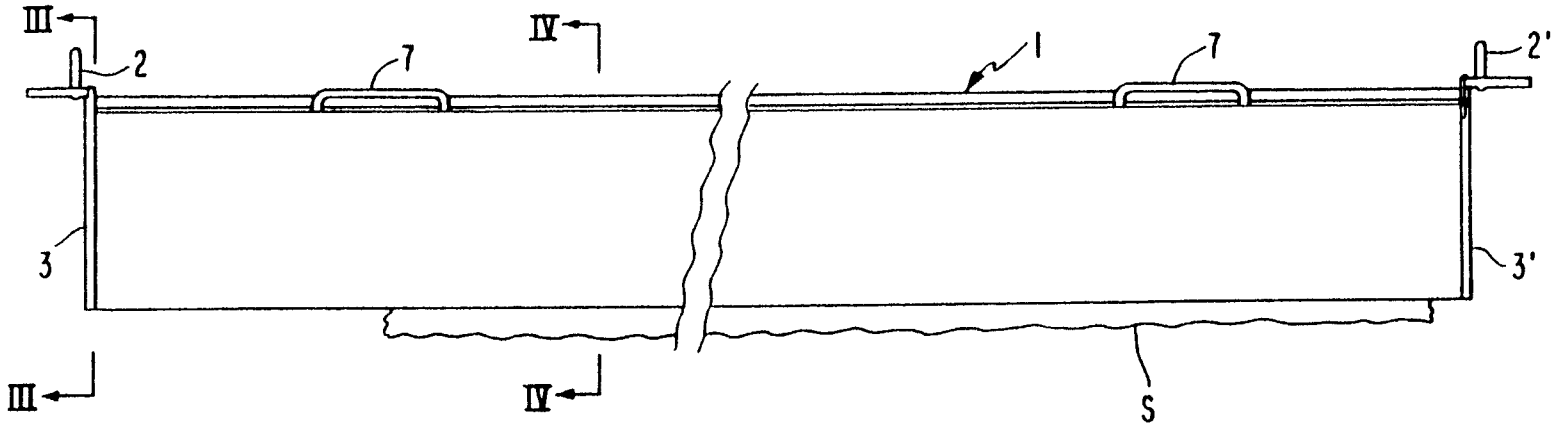
FIG. 2 is a front view of the ink fountain box of FIG. 1.

Referring first to FIGS. 1 and 2:

The inker box 1 has two side parts 3, 3'. Lifting handles 2, 2' are formed on the side parts, for easy handling and transporting of the inker box. The inker box can be located on a printing machine in any suitable manner, for example by seating it in an inker body 20 (FIG. 6) only schematically shown at S in FIG. 2. Locating and positioning arrangements, as well known in the printing machinery art, may also be provided. The inker box can be quite long, for example over 1 meter in length; in one embodiment, the length of the inker box was 1.135 meters.

Figure 3:
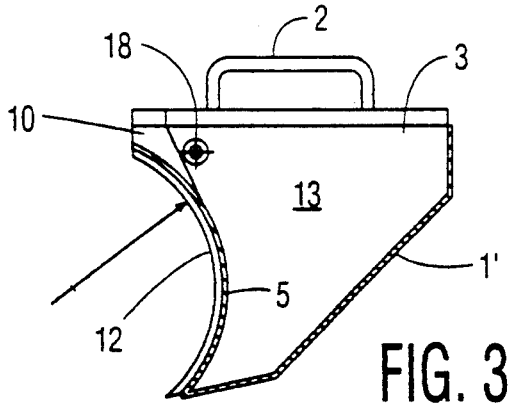
FIG. 3 is a schematic section taken along line III—III of FIG. 2.
Figure 4:
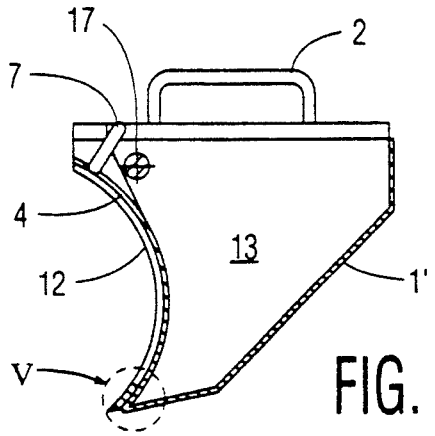
FIG. 4 is a schematic section taken along line IV—IV of FIG. 2.

The inker box defines a reservoir space 13 (FIGS. 3–5) which may hold, for example, over 20 liters of printing ink (approximately 5 gallons). The inker box 1 is formed by a body which defines a rear wall 1' and a bottom wall 1''. The body of the inker box can be angled, as seen in FIGS. 3 and 4, or curved, and the bottom surface can be suitably shaped for support on the printing machine; alternatively, the inker box can be supported on overhangs, as seen in FIGS. 1 and 2, of the side walls 3.

The side walls 3 fit against and close off the inker body 1 at the lateral edges thereof. The forward edge of the side walls 3 is formed with a curved surface 12 which matches the circumference of the an inker roller 9, shown only schematically in FIG. 5, of the printing machine. The forward region 11 of the ink reservoir 13 thus is open to the printing machine roller 5.

Figure 5:
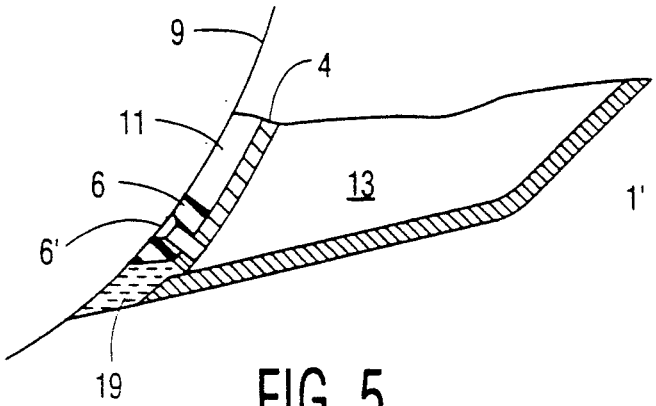
FIG. 5 is a detail view, to an enlarged scale, of the lower portion of the ink fountain box, with the cover inserted, of the region within the circle V—V in FIG. 4.

In accordance with a feature of the invention, the side walls 3 are formed with guides 5, preferably in form of guide slots, having a curvature which has a radius Just slightly greater than the radius of curvature of the inker roller 9, and spaced closely adjacent to the forward edge 12 of the side walls 3, and Just behind the edge of the-side walls. The guide slots 5 are provided to receive a curved forward cover 4, so that the cover 4 can be slid into the slots, and close off the reservoir 13 towards the ink roller. The cover 4 is preferably formed, at its lower end, with a stripping element 6, held in position on the cover 4 by a screw 6' (FIG. 5). The stripper 6 is preferably made of plastic, for example nylon, and is so dimensioned and shaped that it is engageable with the inker roller 9.

USE AND OPERATION

Usually, the inker box 1 is inserted in a printing machine when empty. This, then, does not require lifting a heavy ink-filled fountain box. The cover 4 need not be in position. After placement of the fountain box, the reservoir 13 can be filled with ink, and the ink will flow into engagement with the inker roller 9.

To remove the inker box, the cover 4 is slid in position in the guide slots 5, and follows the curved guide path thereof. The cover 4 is preferably pre-curved to fit into the slots in the guide path directly. Upon insertion, the stripper element 6 will strip off ink which has accumulated along the surface of the roller 9. This cleans off at least a portion of the inker roller 9. This accumulated, stripped off ink is shown schematically at 19 in FIG. 5. The reservoir 13, now, is closed, and the bottom of the cover 4, in engagement with the body 1', closes off the bottom. The ink, which is highly viscous, will be retained within the reservoir and any leakage can be easily removed, together with the remanent stripped off ink 19. No ink will run out of the reservoir within the time usually required to remove the inker fountain box 1, with the cover 4 in place, and transport it to an ink replacement or exchange position, where any remaining ink within the reservoir 13 can be removed, or the inker box cleaned. It is possible that a slight amount of ink will leak into the region of the stripped ink 19, which, however, can be neglected.

Insertion of the cover 4 is facilitated by forming the slot 5 with a widened upper end portion 10 (FIG. 3). The cover 4 is preferably formed with handles 7 (FIGS. 1, 2) for ease of insertion and removal. The side walls 3, 3' are tied together by a cross rod 17 located in the upper portion of the region of the side walls facing the inker roller 9, and locked in position by suitable lock nuts 18.

The cover 4 can be made of metal, for example aluminum. The side walls 3 may be made of plastic. The stripper element 6, likewise, is preferably made of plastic. Other materials are also suitable. Rather than defining the guide path for the cover 3 by a slot 5, other guide arrangements may be used, for example projecting ribs or guide ridges, guide buttons and the like.

The ink tray 1 is, usually, retained in the printing machine within an inker fountain body 20, in which it is seated, and suitably held in position, for example by a clamp 21. Ink is stripped off the inker roller 9 by a doctor blade 22, secured by screws, shown only schematically, to the inker body 20. The end of the doctor blade 22 which engages the inker roller 9 can be adjusted with respect to the roller by a cam 24, rotatable about a shaft 25.

It has been found that, in operation, ink 19 will accumulate in the small space or gap between the bottom portion 1'' of the ink tray 1 and the top of the doctor blade 22. This, in part, is due to the rotation of the inker roller 9 which is in the direction of the arrow A. Ink, thus, is actually pressure-fed due to the rotation of the roller 9 into the space or gap between the wall 1'' at the bottom of the ink train 1 and the top surface of the doctor blade 22, which closes off the inker body 20.

The bottom wall 1'' of the ink tray 1 is bent into a very shallow, flat S shape. The rear end portion 26*a* of the bottom wall 1'' of the ink tray is blocked off at the lower side by a block 23 of plastic, for example nylon, or of rubber.

In accordance with a feature of the invention, the bottom wall 1'' is so shaped that it defines an opening for ingress of ink into the inker space 13, when the ink is fed by rotation of the inker roller. This opening may be merely a foreshortening of the bottom wall 1'', or may be formed by a series of holes drilled or punched into the bottom wall 1''. The opening can be closed off by a flap valve which can remain in position in the insert box or fountain box, or can be part of the slidable cover 4, or a sealing element on cover 4.

Figure 6:
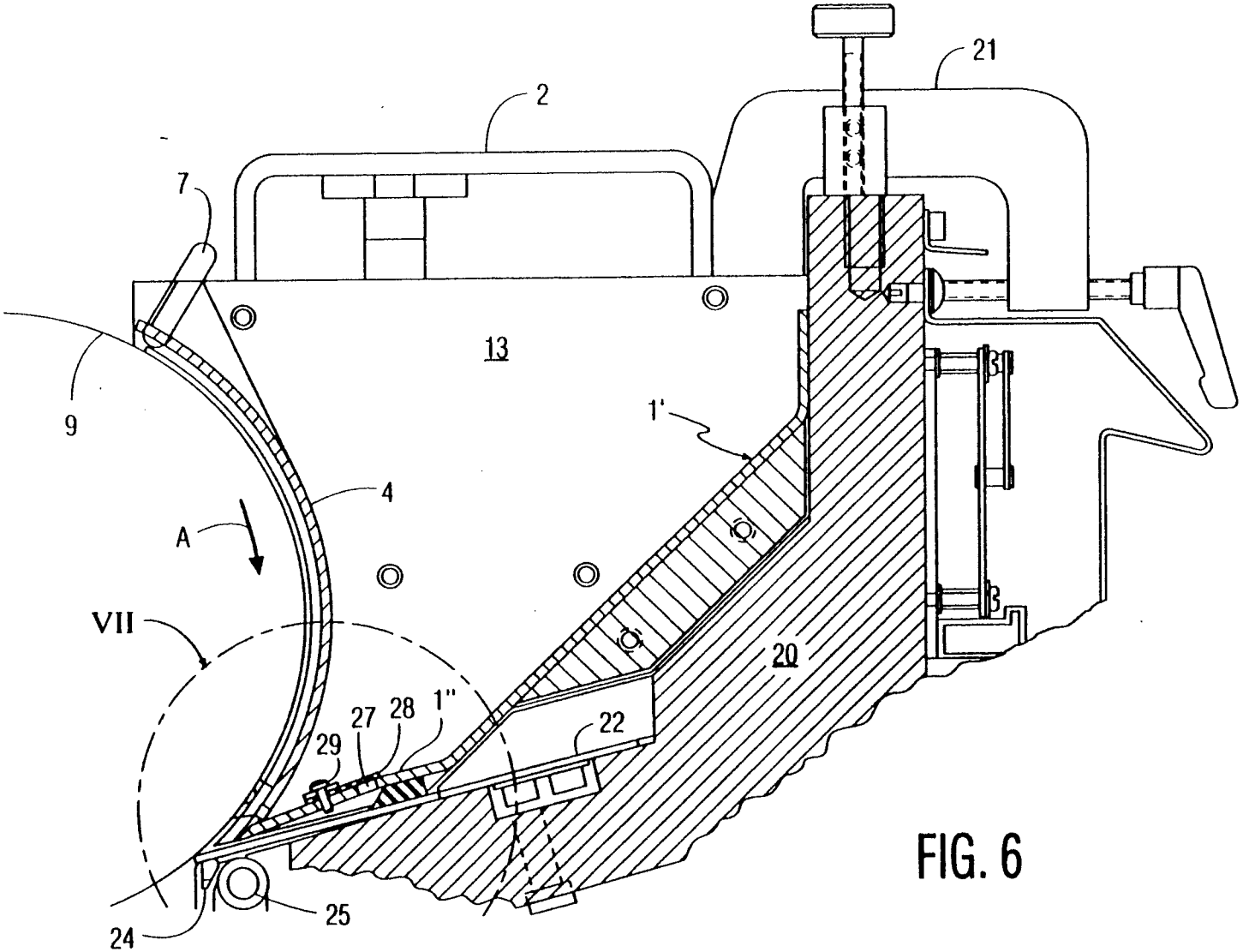
FIG. 6 is a highly schematic side view of the fountain box installed in an inker body, and illustrating a flap valve to permit escape of ink which can collect between the fountain box and the inker body.
Figure 7:
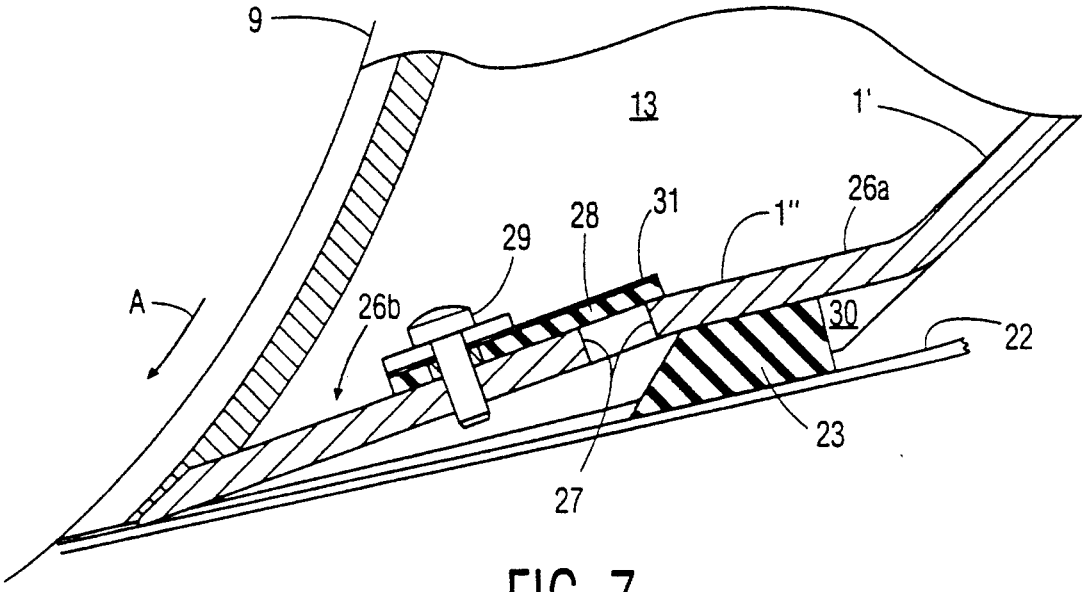
FIG. 7 is a highly enlarged fragmentary detail view of the structure of FIG. 6 within the circle VII of FIG. 6.
Figure 8:
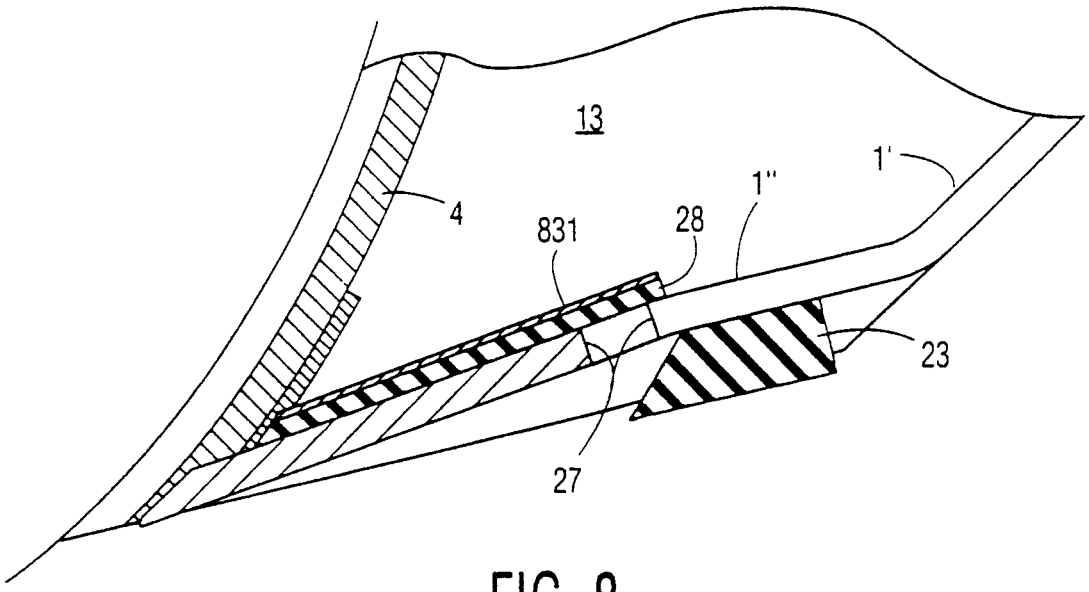
FIG. 8 is a view similar to FIG. 7 and illustrating a modification.

In the embodiment of FIGS. 6 through 8, the bottom wall 1" is formed with a series of axially located holes 27. This permits ink to escape from the forward portion 26*b* of the bottom wall 1" of the ink tray. To prevent outflow of ink through the holes, the holes 27 are covered at the top by a flap 28 of a flexible material, e.g. rubber, suitably retained in position, for example by screws 29. The combination of the holes 27 and flap 28 forms a flap valve which permits ink fed by hydraulic pressure due to rotation of the roller 9 beneath the lower wall 1" of the ink tray and above the doctor blade 22 to escape into the interior of the ink tray 1. Upon removal of the ink tray 1, however, pressure of the remaining ink within the ink tray will close the flap 28 against the openings 27.

The block 23 can be backed up by a shoulder or by fins 30, formed on the ink tray 1.

Sealing of the bottom has been a real problem. Ink which flows up between the doctor blade 22, and/or the body 20 of the fountain, and the ink tray 1, very difficult to remove. Providing a flap seal, for example using a rubber flap for the element 28, in combination with the holes 27, relieves the pressure due to rotation of the anilox roller 9 and escaping above the doctor blade 22. Upon stopping of rotation of the doctor blade, there will no longer be any pressure upwardly through the holes 27 against the resilient flap. Flap 28 then can seal itself against the bottom 1" of the ink tray. Flap 28 suitably is rubber; other flexible materials unaffected by the ink in the fountain box may be used.

The thickness of the flexible flap 28 can be reduced if it is backed up by a spring steel plate 31 which, for example, may have a thickness in the order of about 0.15 mm. Other arrangements than a hold-down screw 29 may be used, the hold-down screw 29 being merely illustrative of one arrangement. Preferably, the hold-down arrangement for the valve flap 28/31 should be such that the bottom of the ink tray 1 is easy to clean. Consequently, rather than using the projecting screws 29, a cover strip with recessed attachment screws for example or another essentially smooth arrangement may be used to provide an essentially smooth outline to the bottom of the tray 1.

In accordance with another feature of the invention, as schematically illustrated in FIG. 8, the flap 28 is attached to the slidable shield or cover 4, rather than to the bottom wall 1" of the inker tray. FIG. 8 illustrates the cover with the flap 28 and spring 831 in position. Spring 831, in cross section, is L-shaped and suitably attached to cover 4, e.g. by rivets, spot welds, or the like.

In use, the cover 4 together with the flap 28 will be removed, of course. Holes 27 permit unobstructed return flow of ink accumulating above the doctor blade (not shown in FIG. 8). Before removal of the tray 1, the cover or shield 4 is inserted, and the flap 28 will then close against the openings 27. This inker is particularly suitable for readily flowable ink so that the cover or shield 4, even with the flap 28 attached, particularly if held down by an additional spring element 831, will readily seal itself against the openings 27, particularly if some ink is left in the ink tray 1 so that the pressure of the remaining ink in the tray 1 will force the flap 28 against the openings 27. In such constructions, the openings 27 can be moved forwardly with respect to the position shown in FIG. 8; the location of the openings 27 can readily be determined by a few experiments; more than one parallel row of openings, or openings staggered with respect to each other, may be used. The flap 28 can be attached to the shield or cover 4, for example by an adhesive, or by a thickened inner end (not specifically shown in FIG. 8) and a screw connection, similar to the nylon end piece 6 (FIG. 5), or adhered to one leg of the L-shaped spring 831.

Figure 9:
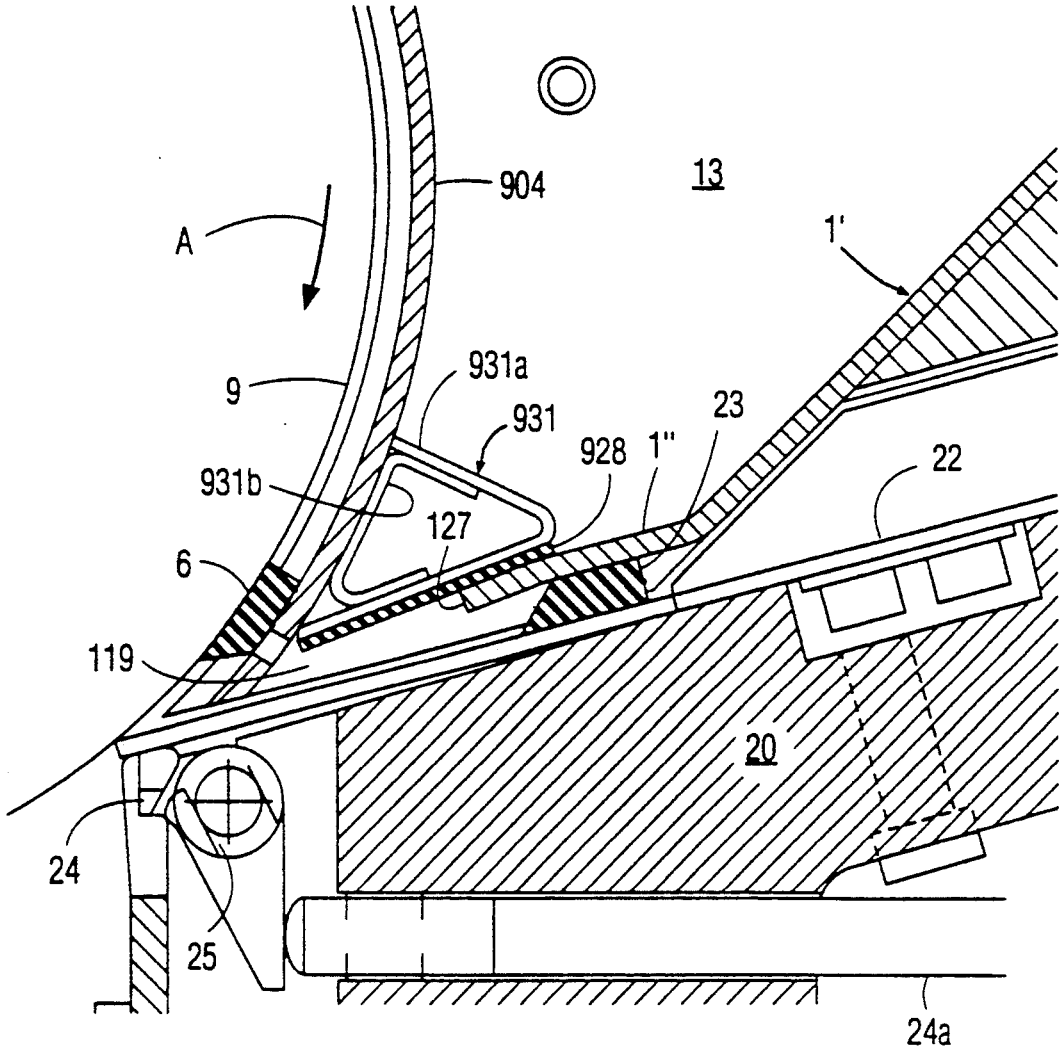
FIG. 9 is view similar to FIG. 7, and illustrating yet another modification.

FIG. 9 illustrates another arrangement in which the end of bottom wall 1" of the fountain insert or fountain box 1 is foreshortened, as seen at 127. FIG. 9 illustrates the fountain box when the machine is not in operation, that is, upon insertion or just prior to removal of cover 904. The cover 904 is closed. The bottom of the cover 904 retains a holder or spring element 931, secured to the cover 904, for example by rivets, spot welds or the like. FIG. 9 illustrates the retention spring as a two-part structure, having a generally U-shaped inner clip 931 which is riveted or spot-welded to the cover 904. The inner part 931*b* is surrounded by an outer spring clip 931*a*. The outer part 931*a*, of course, extends in form of a rail axially across the width of the inker box. The inner part 931*b* may also extend in form of a rail across the axis of the inker but, alternatively, individual holding clips 931*b* can be secured to the cover 904. The bottom of the holding strip 931 has a sealing flap or sealing strip 928 secured thereto, suitably of rubber, or similar material. Generally L-shaped spring elements, similar to the spring 831 (FIG. 8), may also be used.

When the machine is operated, the cover 904 together with the holder spring 931 and the sealing strip 928 are removed. Ink will accumulate in the space 119, that is, between the end 127 of the bottom wall 1" of the inker insert 1, and the top of the doctor blade 22. The quantity of ink is small. For removal, the cover 904 is inserted, which seals the opening defining the space 119, and permits removal of the ink box. Additionally, easy access is possible to the region above the doctor blade 22 for cleaning the remaining ink in the space 119. Upon insertion of the cover 904, the flexible element 6 will wipe against the surface of the inker roller 9, wiping off ink into the space 119 which, until the sealing strip 928 has sealed off the space 119, can escape into the inker chamber 13. FIG. 9 also shows an adjustment spindle 24*a*, which can be reciprocated back and forth to operate the cam 24.

The stripper element 6 strips ink accumulated on the surface of the inker roller 9, and bridges the gap between the cover 4, or 904, respectively, and the surface of the inker roller 9. This gap, typically, is about 5 mm.

Various changes and modifications may be made, and any features described herein may be used with any of the others, within the scope of the inventive concept.

We claim:

1. Portable, removable and insertable ink fountain box (1) for a printing machine, defining an ink reservoir. (13), wherein the printing machine has an inker roller (9) and means (S) for supporting the ink fountain box in position, facing the inker roller, and said fountain box is formed with an open region (11) facing the inker roller so that ink in the fountain box will be applied to the inker roller, said fountain box comprising a body (1) defining a back wall;

two side walls (3, 3'), each connected to the body and having forward free edges (12) which are curved to match the curvature of the ink roller (9) and fitting, when in ink application position, against the inker roller (9);

a removable closure cover (4) fitting between the side walls; and guide means (5) formed on the side walls adjacent the forward free edges (12) thereof, and defining a guide path which is at least approximately parallel to said curved forward edges (12) for guiding the removable closure cover (4) and selectively retaining said cover in position with a lower edge thereof essentially in engagement with a bottom of the body (1), to permit removal of the fountain box without spillage of ink from the ink reservoir (13).

2. The fountain box of claim 1, wherein said guide means (5) comprises guide slots formed in the side walls (3).

3. The fountain of claim 1, wherein said guide means (5) are formed with an enlarged guide region (10) adjacent an upward portion thereof where the cover element is insertable into said guide means.

4. The fountain box of claim 1, further including handles (2) formed on the side walls (3, 3').

5. The fountain box of claim 1, further including cover handles (7) secured to the cover (4) for operator-guiding of the cover (4) into said guide means (5).

6. The fountain box of claim 1, wherein said cover (4) is of metal and wherein the side walls (3) optionally comprise plastic material.

7. The fountain box of claim 1, further including an ink stripper (6) Secured to the closure cover (4) at the side thereof facing the inker roller, said ink stripper being dimensioned for engagement with the inker roller (9) when the cover (4) is inserted in said guide means (5).

8. For combination with an inker body (20) of a printing machine, a portable, removable and insertable ink fountain box (1) defining a ink reservoir space (13), wherein the printing machine has an inker roller (9), said inker body (20) supporting the ink fountain box (1) in position in the printing machine, facing the inker roller (9), wherein said fountain box (1) is formed with an open region (11) facing the inker roller so that ink in the fountain box will be applied to the inker roller, said fountain box comprising a body (1) defining a back wall;

two side walls (3, 3'), each connected to the body and having forward free edges (12) which are curved to match the curvature of the ink roller (9) and fitting, in ink application position in said inker body (20) against the inker roller (9);

a removable closure cover (4, 904) fitting between the side walls; and guide means (5) formed on the side walls adjacent the forward free edges (12) thereof, and defining a guide path which is at least approximately parallel to said curved forward edges (12) for guiding the removable closure cover (4) and selectively retaining said cover in position with a lower edge thereof located in the vicinity of a bottom wall (1") of the body; and an ink pressure relief arrangement to prevent accumulation of ink between the inker body (20) and a bottom wall (1") of the fountain box, said ink pressure relief arrangement comprising at least one opening (27, 127) formed in the bottom wall (1") of the ink fountain box (1); and a sealing element (28, 928) positionable over said opening when the removable closure cover (4) is in a position with a lower edge thereof in the vicinity of the bottom wall (1") of the box (1) to seal the opening with respect to ink within the fountain box (1), but permit ingress of ink fed beneath the ink fountain box and the inker body (20) upon rotation of the inker roller (9).

9. The fountain box of claim 8, wherein said sealing element comprises a resilient flap (28) secured to the bottom wall (1") of the body of the fountain box.

10. The fountain box of claim 8, wherein said sealing element (28, 128) is secured to said removable closure cover (4, 904).

11. The fountain box of claim 8, further including a resilient spring back-up element (31) located on said sealing element for reinforcing the hold-down effect of the sealing element, said resilient spring element (31, 831) being in engagement with said sealing element (28, 928).

12. The fountain box of claim 8, wherein said at least one opening is formed by a recess (127) in the bottom wall (1") of said fountain box (1), said recess extending away from the surface of the inker roller (9).

13. The fountain box of claim 8, wherein said at least one opening comprises a plurality of holes (27) formed in the bottom wall (1") of the body of the ink fountain box (1), and said sealing element comprises a resilient flap (28) engageable over said holes.

14. The fountain box of claim 8, further including a bottom sealing element ( (23) located at the underside of said bottom wall (1") of the body of the fountain box (1), and positioned, with respect to the inker roller (9), behind said at least one opening (27, 127) to define an ink accumulation space (119), said opening permitting passage of leakage ink from said accumulation space (119) into the interior of the ink fountain box (13) from beneath said bottom wall (1").

15. The fountain box of claim 8, wherein said sealing element is made of a material unaffected by ink in the fountain box, and optionally is rubber.

16. The fountain box of claim 8, further including a holding element (831, 931) secured to said cover (4, 904) said holding element retaining said sealing element (28, 928) in overlapping position with respect to said at least one opening (27, 127) .

17. The fountain box of claim 16, wherein said holding element (831, 931) includes a rail element extending essentially parallel to the axis of said inker roller (9) and across the width of said fountain box, and hence of said cover (4, 904).

18. The fountain box of claim 17, further including an ink stripper (6) secured to the closure cover (4 , 904) at the side thereof facing the inker roller, said ink stripper being dimensioned for engagement with the inker roller (9) when the cover is inserted in said guide means, and stripping ink into an ink accumulation space (119) beneath the ink fountain box (1), and the inker body (20).

19. The fountain box of claim 16, wherein said holding element (831, 931) is resilient to provide for yielding sealing engagement of said sealing element over said at least one opening.

20. The fountain box of claim 8, further including cover handles (7) secured to the cover (4) for operator-guiding of the cover (4) into said guide means (5).

21. The fountain box of claim 8, wherein said cover is of metal, optionally aluminum.

* * * * *